United States Patent [19]

Wilkinson

[11] 4,122,332

[45] Oct. 24, 1978

[54] BUNKER CONTENTS INDICATION EQUIPMENT

[75] Inventor: John Joseph Wilkinson, Burton upon Trent, England

[73] Assignee: Coal Industry (Patents) Limited, London, England

[21] Appl. No.: 801,427

[22] Filed: May 27, 1977

[30] Foreign Application Priority Data

Jun. 11, 1976 [GB] United Kingdom ..... 24290/76

[51] Int. Cl.[2] ..... G06M 3/06

[52] U.S. Cl. ..... 235/92 CA; 235/92 CV; 235/92 MP; 235/92 R

[58] Field of Search ..... 235/92 PK, 92 PE, 92 CA, 235/92 GD, 92 MP, 103; 340/246

[56] References Cited

U.S. PATENT DOCUMENTS

| | | | |
|---|---|---|---|
| 3,298,019 | 1/1967 | Nossen | 235/92 CA |
| 3,391,275 | 7/1968 | Bullock et al. | 235/92 CA |
| 3,548,169 | 12/1970 | Togneri | 235/92 CV |
| 3,752,969 | 8/1973 | Kiffmeyer et al. | 235/92 CA |
| 3,917,928 | 11/1975 | Wesner | 235/92 CA |

*Primary Examiner*—Joseph M. Thesz

*Attorney, Agent, or Firm*—Stevens, Davis, Miller & Mosher

[57] ABSTRACT

A transducer for indicating the percentage filling of an underground mine storage bunker. The contents of the bunker is proportional to the rotation of a shaft of a conveyor which feeds it. The transducer comprises a shaft encoder for sensing this rotation and derives a signal indicative thereof. The signal is fed to a circuitry which includes a visual display for a further signal derived in the circuitry which is equal to the first mentioned signal and a bunker full warning light which is energized when the further signal exceeds a preselected value. The circuitry is compatible with a varied range of input signals.

8 Claims, 6 Drawing Figures

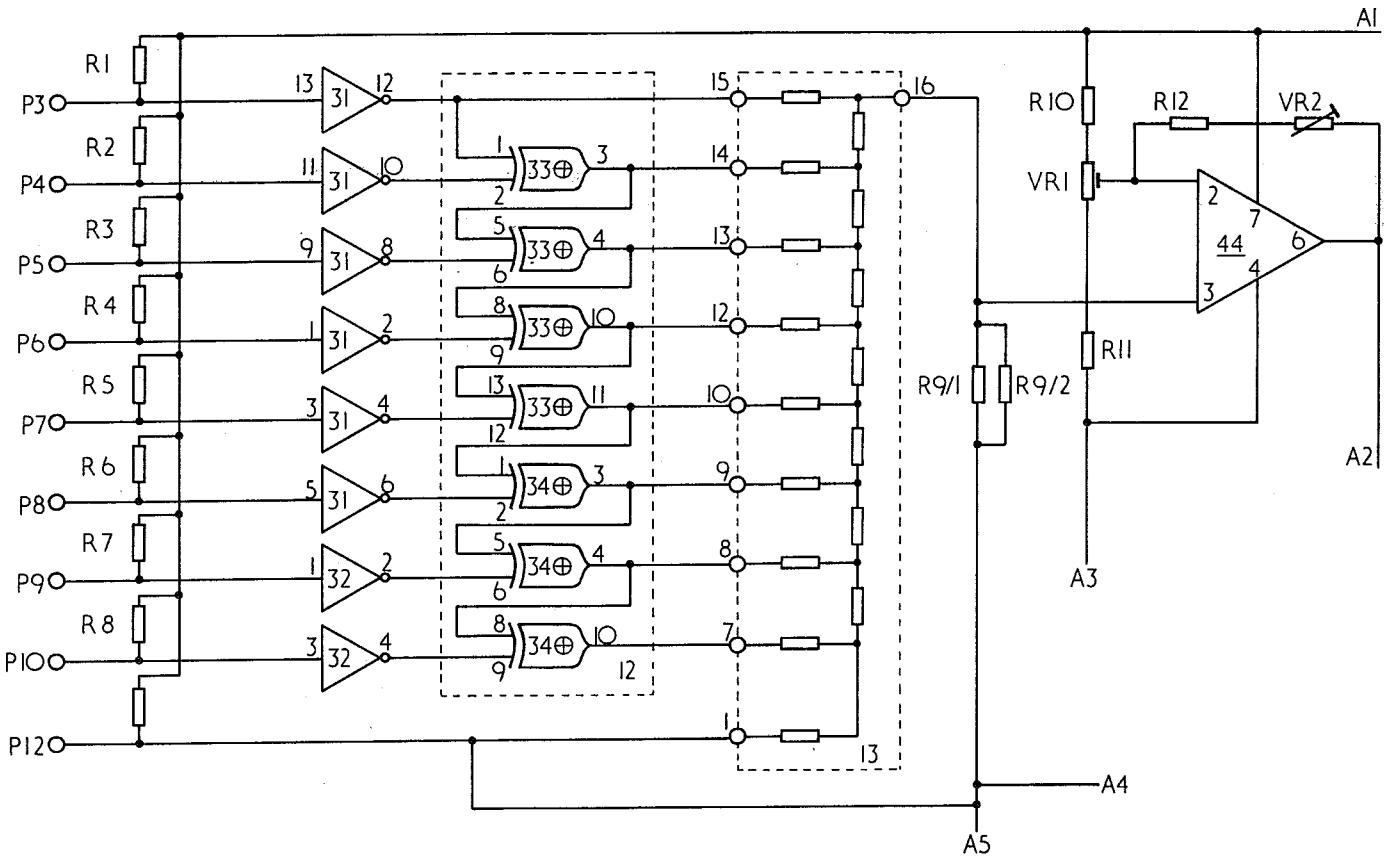
FIG. 3.a.

BUNKER CONTENTS INDICATION EQUIPMENT

The present invention relates to equipment for indicating content of at least one bunker incorporating at least one mechanical component which moves in proportion to the content of the or each bunker.

The operation of known particulate material storage bunkers, with respect to emptying and filling, i.e. their contents, can be both complicated and expensive and the control of such operations can in many cases be dependent upon the vagaries of a human operator.

An object of the present invention is to provide improved indication of the bunker contents in a form easily comprehensible to an operator. It is envisaged that use of the present invention could lead to computer monitoring and control of a plurality of bunkers, enabling the transport and storage of material such as particulate material for example coal, to be achieved with a greater efficiency than hitherto.

According to the present invention equipment for indicating content of at least one bunker incorporating at least one mechanical component which moves in proportion to the content of the or each bunker comprises sensor means attachable to the or each mechanical component for deriving a first electrical signal indicative of the movement thereof, indicator means electrically connected to the sensor means for receiving the electrical signal, the indicator means including visual display means and means for driving the visual display means with a second electrical signal equal in magnitude to the first electrical signal.

Preferably, the means for driving the visual display means comprises a clock and counters connected thereto.

Conveniently, the equipment comprises electrical comparator means for comparing the first and the second electrical signal, the electrical comparator means deriving an output control signal when the first and second signals are equal.

Preferably, a time delay unit is connected to the electrical comparator means output.

Advantageously, the electrical comparator means output controls the clock and the time delay unit output controls the counter.

Preferably the indicator means includes adaptor means connected to the sensor means, which adaptor means constrains the first electrical signal to fall within preselected limits.

Advantageously, the equipment comprises transmission means for transmitting the first signal away from the equipment.

Advantageously, the equipment comprises regulator means for powering the equipment.

By way of example only, one embodiment of the present invention will now be described with reference to the accompanying drawings in which.

Figure 1:
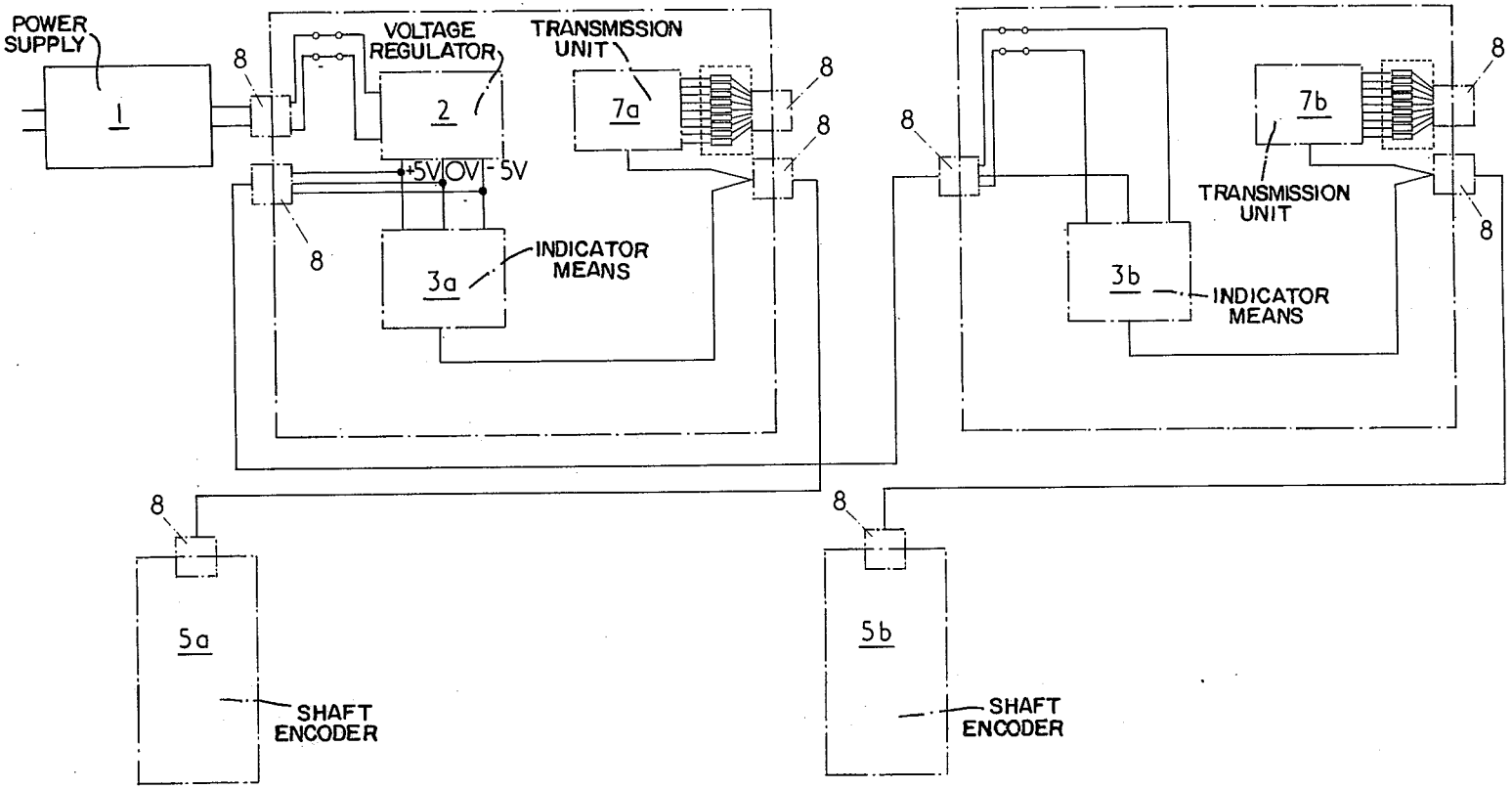
FIG. 1 is a block electrical circuit diagram of equipment in accordance with the present invention and adapted for indicating the contents of two separate bunkers.
Figure 2:
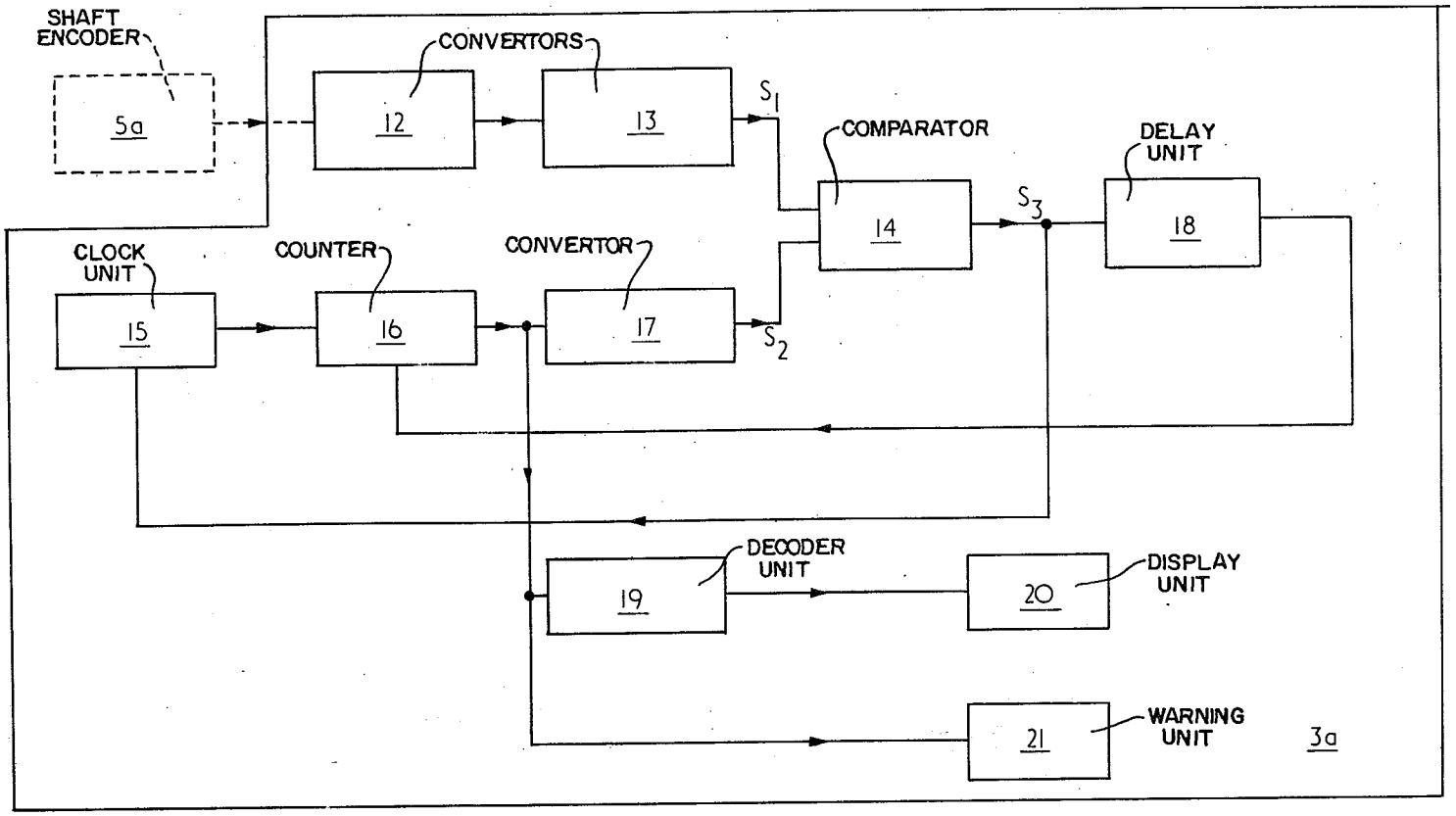
FIG. 2 is a more detailed block electrical circuit diagram of part of FIG. 1.
Figure 3B:
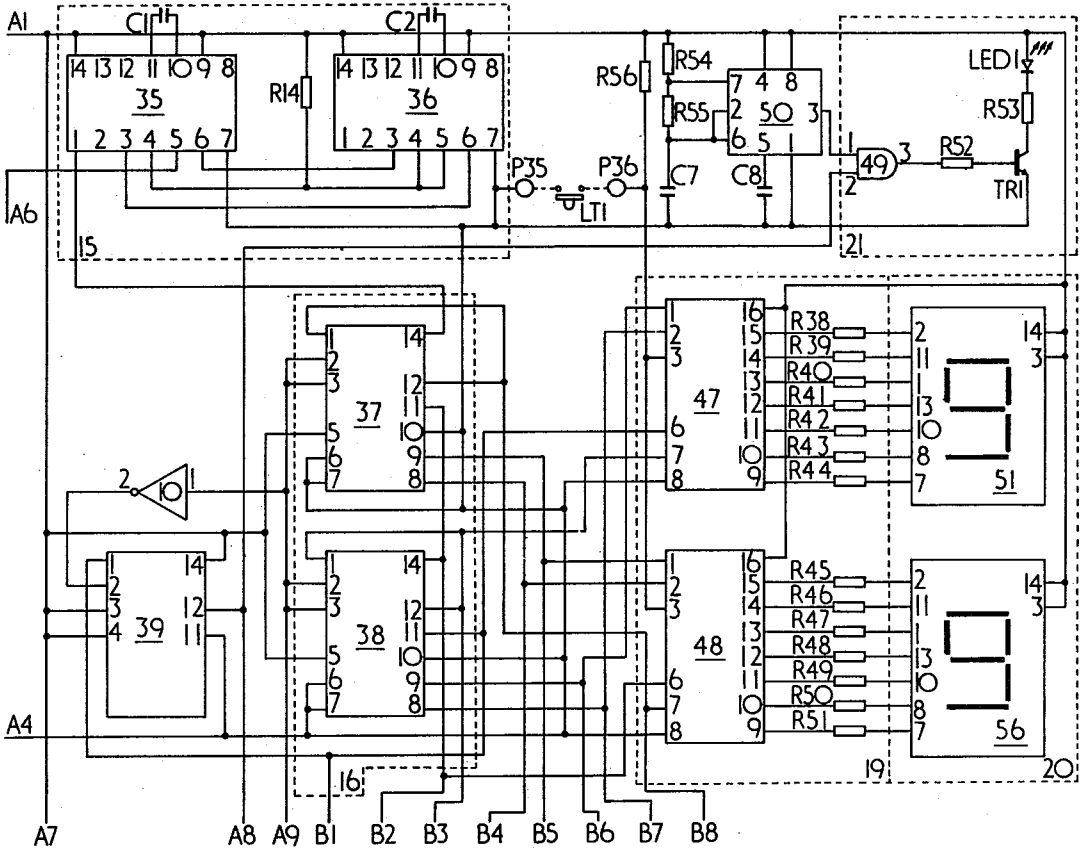
Figure 3C:
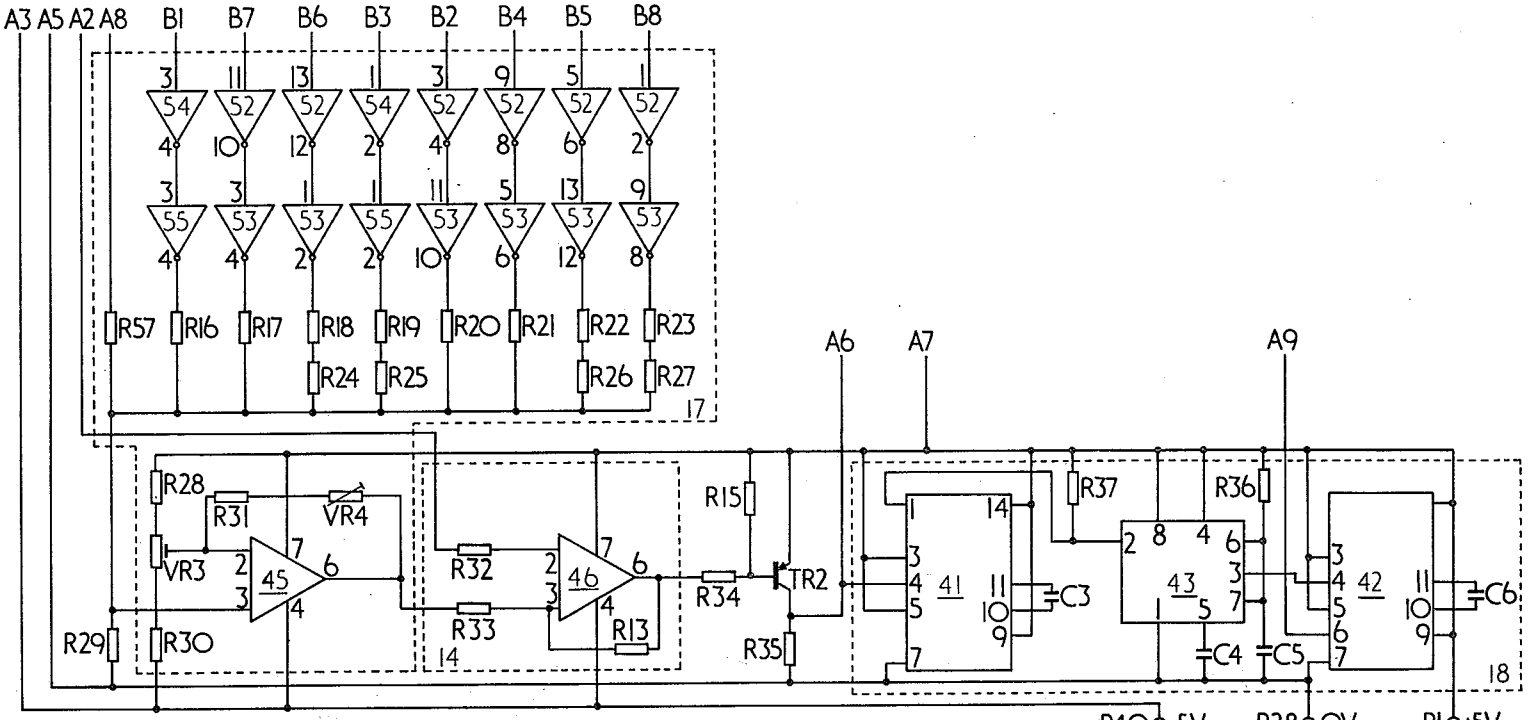
Figure 4:
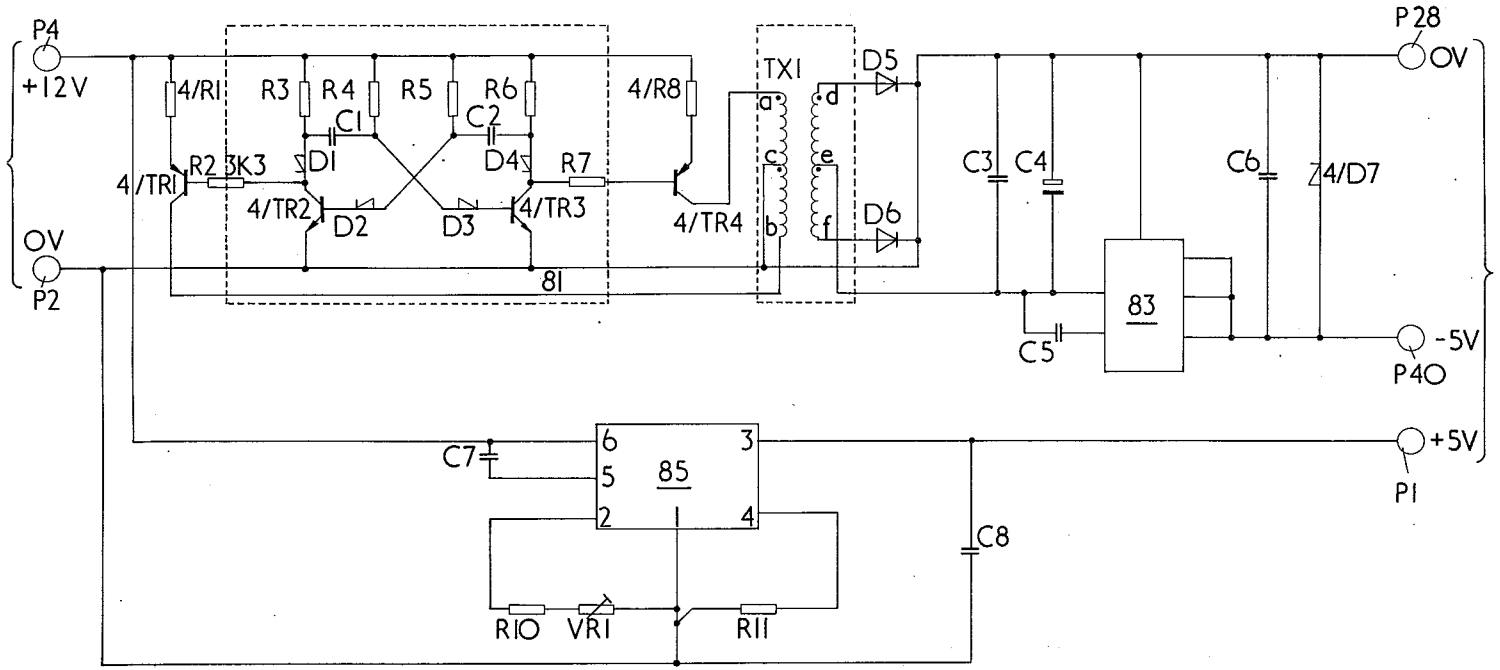

FIG. 3*a* is a detailed electrical circuit diagram of a first part of FIG. 2, FIG. 3*b* is similar to FIG. 3*a*, but shows a second part of FIG. 2, FIG. 3*c* is similar to FIG. 3*a* but shows a third part of FIG. 2;

FIG. 4 is a detailed electrical circuit diagram of another part of FIG. 1.

The equipment of FIG. 1 is suitable for indicating the contents of two separate bunkers not shown in the drawings but each comprising a horizontal container for particulate material and conveyor means extending along the length of the container base for feeding material into or discharging material from the bunker. The conveyor means includes a mechanical component drivably connectible with a conveying portion of the conveyor means such that rotation of the mechanical component, conveniently a shaft, is proportional to the amount of particulate material in the bunker. The equipment of FIG. 1 senses rotation of each rotary shaft and thereby senses the amount of material in each bunker. The equipment of FIG. 1 comprises a power supply 1, voltage regulator means 2, indicator means 3*a*, 3*b*, sensor means comprising shaft encoder means 5*a*, 5*b*, and further transmission units 7*a*, 7*b*.

A plurality of sockets and plugs 8 are provided for interconnecting components 1, 2, 3, 5 and 7 comprising the equipment for indicating content of the bunkers. The indicator means 3*a*, the shaft encoder means 5*a* and the transmission unit 7*a* are adapted for use with the first rotary shaft comprising part of the first of said bunkers and the indicator means 3*b*, the shaft encoder means 5*b* and the transmission unit 7*b* are adapted for use with the second rotary shaft comprising part of the other bunker.

Further details of the shafts and the bunkers mentioned in this application are given in our co-pending British Patent Application No. 25346/76.

Considering for simplicity, the operation of the equipment appertaining to one bunker, then as the first shaft rotates an electrical signal is derived by the shaft encoder means 5*a* which is drivably connected to the first shaft, the derived signal being indicative of the amount of rotation of the shaft. The derived signal is transmitted to the indicator means 3*a* and also to the transmission unit 7*a*. The indicator means 3*a* provides a visual display of the magnitude of the derived signal and thereby of the contents of the bunker. The transmission unit 7*a* is used to transmit the derived electrical signal from the shaft encoder means 5*a* away from the equipment for indicating bunker content. The signal is transmitted for example to a controlling computer or to another analysis of control point.

The indicator means 3*a* and 7*a* is powered by a constant power supply generated by the regulator means 2, the regulator means 2 being powered from a power supply unit 1.

The indicator means 3*b*, the shaft encoder means 5*b* and the transmission unit 7*b* appertaining to the second bunker operate in a manner analogous to the means 3*a*, 5*a* and unit 7*a*. It can be seen in the FIG. 1 that indicator means 3*b* is connected to the regulator means 2, which powers the means 3*b* and 7*b*.

Referring now to FIG. 2, the indicator means 3*a* which is identical to 3*b* is shown in more detail and the shaft encoder means 5*a* which is identical to 5*b* is shown dotted.

The electrical signal which is derived by the shaft encoder 5*a* is Gray coded. The Gray coded signal is converted to a proportional binary coded signal by a convertor 12. The binary output signal from convertor 12 is fed to a further convertor 13 for conversion to an analogue signal $S_1$. The value of the signal $S_1$ although not $S_1$ itself is displayed by the indicator means 3a as described subsequently.

Also provided in the indicator means 3a is a clock unit 15 for deriving periodic pulses. The pulses are fed to a counter 16, which emits a binary coded decimal signal proportional to the number of pulses counted from the clock unit 15. The binary coded decimal signal from the counter 16 is fed to a convertor 17 for conversion to an analogue signal $S_2$.

The analogue signals $S_1$ and $S_2$ are fed to an electrical comparator unit 14. When the signals $S_1$ and $S_2$ are identical an electrical signal $S_3$ is derived by the comparator unit 14. The signal $S_3$ is used for two operations.

Firstly, $S_3$ is tapped to stop the clock unit 15 and secondly, $S_3$ is used to activate an electrical delay unit 18. After a time delay, the delay unit 18 derives a pulse to reset the counter 16.

The clock unit 15 and its dependent circuit components are set to recommence after the counter 16 has been reset.

The binary coded decimal signal from the counter 16 is tapped before conversion into the analogue signal $S_2$ and used for two further purposes. Firstly, when the binary coded decimal signal is below a preselected magnitude, it is fed to a decoder unit 19 which is connected to a display unit 20. The magnitude of the binary coded decimal signal emitted by the counter 16 is displayed by the display unit 20 during the time period defined by the time delay provided by the delay unit 18. Although the signal displayed is the binary coded $S_2$ the value of signal $S_1$ is also in fact effectively determined from the display unit 20, since $S_1$ is equal to $S_2$.

The display unit comprises light emitting diodes (which are shown in more detail in FIG. 3) for displaying the value of the decoded $S_2$ or effective bunker content. In alternative embodiments of the invention, a liquid crystal display could be used, although clearly minor circuit modification is required for this case.

The second further function of the tapped binary coded signal occurs when the magnitude of this signal is greater than a preselected level. In the circuitry, the preselected level is passed when a preselected upper output of the counter 16 comes on. The visual indication is given by a warning unit 21. The unit 21 uses a light emitting diode (shown in FIG. 3) for this purpose. In normal operation of the invention, this warning is given when the bunker is full, since when the bunker is full, the shaft has rotated sufficiently far in the associated direction for the signal $S_1$ from the shaft encoder means 5a to exceed the preselected level of signal $S_2$. Further details of the exact operation of the unit 21 will be given later in this specification with reference to FIG. 3.

Referring to FIGS. 3a, 3b, 3c, a detailed electrical circuit diagram of FIG. 2 is given except that the shaft encoder 5a is not shown. The input to the indicator means 3a from the shaft encoder is through terminals P3, P4, P5, P6, P7, P8, P9, P10 and P12. Power is supplied through terminals P40, P28 and P1. The power input is regulated and is fed from the regulator means 2. In this example the voltage in terminals P40, P28 and P1 is $-5$, $0 + 5$ volts respectively.

Considering the Gray coded input signal on terminals P3 . . . P12, a logic 1 is indicated by a short circuit to the common connection P12 and a logic 0 is indicated by an open circuit. The parallel Gray coded input is fed through invertors 31, 32 for conversion to a positive logic Gray code. The resulting positive logic Gray code can then be converted to a binary code using 'exclusive OR' gates 33 and 34. The binary coded signal from the 'exclusive OR' gates is fed through convertor 13 comprising a ladder network, for conversion to an electrical analogue signal.

The analogue signal is fed through a variable gain amplifier 44. The amplifier is used to ensure that the operational range of the analogue signal is adapted to fall within preselected limits. For example, differing bunkers may give rise to different magnitudes of shaft rotation, despite the circuitry comprising the indicator means 3a being adapted for use with signals falling within the preselected limits. Consequently, the amplifier is used to ensure the range of signal from the rotary shaft falls within 0–1.75V which in this example comprises the preselected limits.

The signal emitted by the amplifier is denoted by $S_1$ is that which was previously mentioned as $S_1$.

The clock arrangement 15 comprises two monostable integrated circuits 35, 36 which are interconnected and use positive feed back for their operation. The frequency of the clock has a fixed value, in this example 7KHz. The counter 16 comprises two integrated circuit counting units 37 and 38. Terminal 1 of monostable integrated circuit 35 in the clock 15 is connected to terminal 14 of counter 37. Terminal 11 of counter 37 is connected to terminal 14 of counter 38. In this way the counter 16 is able to count incoming pulses from the clock unit 15. The counter 37 and 38 derive a binary coded decimal output which is fed to convertor unit 17 for conversion to an analogue signal. The convertor unit 17 comprises low power invertors 52, 54 and Complementary MOS invertors 53, 55 which operate in unison with resistors R16 . . . R27. The purpose of the invertors 52, 53, 54, 55 is to ensure a full swing between on and off for the digital signals from the counter 16. The resistors are chosen both to weight the digital signals to ensure their correct conversion ratio to the analogue signal and also to ensure in association with an amplifier 44, that the total value of the analogue output signal is within the preselected limits, in this example 0–1.75V. The analogue output signal is that aforementioned as $S_2$.

The signals $S_1$, $S_2$ are fed to the electrical comparator unit 14, comprising integrated circuit comparator 46 and associated resistors R32, R33, R13.

When signal $S_2$ becomes equal in magnitude to signal $S_1$, the output from the comparator unit 14, that is terminal 6 of comparator 46 switches high, thereby switching off transistor TR2. The collector voltage of transistor TR2 falls to zero and is connected to terminal 5 of monostable circuit 35 comprising part of the clock 15. In this way, operation of the clock is inhibited.

A monostable circuit 41, included in the electrical delay unit 18 is also triggered by the transistor TR2. The unit 18 comprises two monostable circuits 41, 42 and a timer 43. The timer 43 is triggered by the monostable circuit 41, and the timer 43 gives an output pulse of a selected period, in this example approximately 1 second. When the selected period has elapsed, the monostable circuit 42 is triggered.

The counters 37 and 38 are reset through terminal 6 of the monostable circuit 42. As in consequence of the resetting the output of convertor 17 falls to zero, the output of comparator 14 switches low and the transistor TR2 is turned on. The collector voltage of TR2 consequently rises again, in this example to 5V and enables the clock 15 to restart. The cycle is consequently able to recommence.

The output from the counters 37 and 38 is fed to the decoder unit 19 so that the value of $S_2$ may be decoded for display purposes. The decoder unit comprises two seven segments decoders 47 and 48 and resistors R38 . . . R51, each of value 560 ohm in this example. The resistors R38 . . . R51 are provided to limit the current from the decoders 47 and 48.

The decoded output from decoder unit 19 is fed to the display unit 20. The display unit 20 comprises two seven segment light emitting diode displays for displaying the numbers 0 to 99 in this example, although as previously mentioned, it could comprise liquid crystal displays in alternative embodiments of the invention. The numbers 0 to 99 correspond to 0–1.75 volts being the preselected limits in this example, and consequently percentage value of bunker content is displayed by unit 20. The number is displayed for 1 second in this example, the one second being the time delay afforded by the time delay unit 18 described above. A lamp test switch LT1 is incorporated into the circuitry in order to check the correct functioning of the display unit.

A flip-flop unit 39 is connected to terminal 11 of counter 38. Terminal 11 is turned on when the counters reach a preselected level, corresponding to the bunker being full and in this example a value of 99 being indicated on the display unit 20. In this example, the analogue signal derived from the counters is 1.75V when terminal 11 is turned on. In effect terminal 11 is turned on when the signal $S_1$ reaches a magnitude which corresponds to the value of rotation of the previously mentioned shaft corresponding to bunker full.

The output of the flip-flop unit 39 is connected to a dual input AND gate 49, which is included in the warning unit 21. The unit 21 comprises a light emitting diode LED 1, a transistor TR1 and two resistors R52 and R53.

The other terminal of the AND gate is connected to a timer unit 50. The timer unit is connected, in this example, as a free running multivibrator of frequency 4Hz.

When the flip-flop unit 39 is switched, the output of the AND gate is a 4Hz square wave which drives the light emitting diode LED1. Consequently when the bunker is full, it is indicated by the light emitting diode LED 1 which flashes.

Turning now to FIG. 4 which shows the regulator means (2 in FIG. 1) in more detail and comprising a multivibrator 81, a transformer TX1 and two voltage regulator units 83 and 85. The regulator means is employed in order that a power supply, in this example 12V across terminals $P_2$ and $P_4$ is able to supply outputs of +5, 0, −5V to terminals P40, P28 and P1 respectively.

A known regulator unit 85, together with external current limiting and voltage selecting circuit components is used to derive the +5V regulated output.

A d.c. to d.c. convertor is used to generate the −5V output, comprising the free running multivibrator 81, the transformer TX1, the voltage regulator 83 and suitable current limiting and voltage selecting circuit components.

The −5V output is generated by the driving of transformer TX1 through transistors 4/TR1 and 4/TR4 by the multivibrator 81, oscillating in this example with frequency 10 KHz.

Resistors 4/R1 and 4/R8 limit the transformer primary current and the output from the transformer is rectified and fed to the voltage regulator unit 83. Diode 4/D7 is connected in order to safeguard the regulator unit 83 from connection of a positive supply across the −5V output.

It can be seen from the above description that equipment for displaying visually on a linear scale the amount of particulate material in at least one bunker is provided.

In other embodiments of the invention, electrical signals arising within the circuitry of the invention such as the binary coded $S_2$ instead or in addition to the Gray coded input from the shaft encoder means are interfaced for transmission to a further data storage or analysis point.

What is claimed is:

1. An apparatus for indicating the contents of a container having at least one mechanical component moving in proportion to the contents of said container comprising:

sensor means attached to said mechanical component for providing a first electrical signal proportional to movement of said mechanical component; and, indicator means for receiving said first electrical signal and displaying its magnitude, said indicator means comprising:

clock means for generating a pulsed electrical signal;

means for counting the pulses in said pulsed electrical signal and providing a second electrical signal representative of said counted pulses;

means for comparing said first and second electrical signals and for providing an output control signal when said first and second electrical signals represent equal values, said clock means being responsive to said output control signal to stop providing pulses;

time delay means responsive to said output control signal for providing a reset pulse to said counter a predetermined period of time after said output control signal appears; said clock means being further responsive to said reset pulse to recommence generating said pulsed electrical signals; and, visual display means for displaying a value represented by said second electrical signal.

2. An apparatus as in claim 1 wherein said first and second electrical signals are initially in digital form and are converted by digital-to-analog converters to analog form for comparison in said means for comparing.

3. An apparatus for indicating the contents of a container having at least one mechanical component moving in proportion to the contents of said container comprising:

sensor means attached to said mechanical component for providing a first electrical signal proportional to movement of said mechanical component;

clock means for generating pulsed electrical signal;

means for counting the pulses in said pulsed electrical signal and providing a second electrical signal representative of said counted pulses;

means for comparing said first and second electrical signals and for providing an output control signal when said first and second electrical signals represent equal values;

display means for displaying the value represented by said second electrical signal; and, means responsive to said output control signal for causing said second electrical signal to be maintained at a constant value and said display means to display said constant value for a predetermined period of time following the generation of said output control signal.

4. An apparatus as in claim 3 wherein said means responsive to said output control signal prevents said clock means from generating said pulsed electrical signal when said output control signal is present and resets said means for counting after said predetermined period of time.

5. An apparatus as in claim 4 wherein said means responsive to said output control signal includes a time delay unit for resetting said means for counting.

6. An apparatus as in claim 3 further comprising a warning unit responsive to said second electrical signal for providing a visual warning when the value of said second electrical signal exceeds a predetermined value.

7. An apparatus as in claim 3 further comprising an adapter means connected to said sensor for receiving said first electrical signal and for constraining the value represented by said first electrical to fall within preselected limits.

8. An apparatus as in claim 3 wherein all components of said system are powered from a regulated power supply.

* * * * *